US009717377B2

(12) United States Patent
Cattacin et al.

(10) Patent No.: US 9,717,377 B2
(45) Date of Patent: Aug. 1, 2017

(54) SYSTEM FOR DISPENSING A STRIP OF ABSORBENT PRODUCT WOUND INTO A ROLL THAT COMPLIES THEREWITH

(75) Inventors: Gilles Cattacin, Colmar (FR); Nicolas Pommier, Colmar (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 13/811,931

(22) PCT Filed: Jul. 12, 2011

(86) PCT No.: PCT/FR2011/000412
§ 371 (c)(1),
(2), (4) Date: Jan. 24, 2013

(87) PCT Pub. No.: WO2012/013871
PCT Pub. Date: Feb. 2, 2012

(65) Prior Publication Data

US 2013/0119183 A1 May 16, 2013

(30) Foreign Application Priority Data

Jul. 29, 2010 (FR) ..... 10 56268

(51) Int. Cl.
*A47K 10/36* (2006.01)
*A47K 10/16* (2006.01)

(52) U.S. Cl.
CPC ..... *A47K 10/3662* (2013.01); *A47K 10/16* (2013.01)

(58) Field of Classification Search
CPC .... B65H 75/10; B65H 75/00; B65H 2701/31; G03B 17/30; A47K 10/36; A47K 10/38; B21C 47/34
USPC ..... 242/160.1, 160.4, 912, 563–563.2, 242/564–564.1, 564.3–564.5, 565
See application file for complete search history.

(56) References Cited

U.S. PATENT DOCUMENTS 2,739,371 A * 3/1956 Grisdale et al. ..... 29/605
3,016,137 A * 1/1962 Pollock ..... 242/160.1
3,134,980 A * 5/1964 Alexander ..... 156/220
4,530,472 A * 7/1985 Voss et al. ..... 242/588.1
4,989,801 A * 2/1991 Thomas et al. ..... 242/588
(Continued)

FOREIGN PATENT DOCUMENTS

CN 1334192 A 2/2002
CN 1481990 A 3/2004
(Continued)

OTHER PUBLICATIONS

Office Action issued Nov. 28, 2016 in Mexican Patent Application No. MX/a/2013/000977 (3 pages) with a partial English translation (3 pages).

*Primary Examiner* — Emmanuel M Marcelo
*Assistant Examiner* — Michael Gallion
(74) *Attorney, Agent, or Firm* — Drinker Biddle & Reath LLP

(57) ABSTRACT

A system including a roll formed from a web having at least one characteristic mark of the roll, and a dispenser which has an element for identifying this mark in order to determine whether a new roll installed in the dispenser is a compatible roll. The mark is present on a free end section of the new roll. This marked free end section is followed by at least one section that does not have a characteristic mark of the roll.

9 Claims, 2 Drawing Sheets

(56) References Cited

U.S. PATENT DOCUMENTS

| | | | | |
|---|---|---|---|---|
| 5,651,511 | A * | 7/1997 | Crowley et al. | 242/420.3 |
| 5,694,156 | A * | 12/1997 | Hoisington et al. | 347/7 |
| 6,105,898 | A * | 8/2000 | Byrd et al. | 242/564.1 |
| 6,805,317 | B1 * | 10/2004 | Andersson et al. | 242/532.3 |
| 6,903,654 | B2 * | 6/2005 | Hansen et al. | 340/562 |
| 6,977,588 | B2 * | 12/2005 | Schotz et al. | 340/562 |
| 7,040,566 | B1 * | 5/2006 | Rodrian et al. | 242/563 |
| 7,264,194 | B2 * | 9/2007 | Gassner et al. | 242/555.3 |
| 7,793,608 | B1 * | 9/2010 | Udouj | 116/200 |
| 7,878,442 | B2 * | 2/2011 | Malecot et al. | 242/535.3 |
| 8,160,742 | B2 * | 4/2012 | Goerg et al. | 700/240 |
| 8,511,598 | B2 * | 8/2013 | Neveu et al. | 242/563 |
| 8,544,785 | B2 * | 10/2013 | Pelland et al. | 242/563 |
| 2003/0041716 | A1 * | 3/2003 | Takashima | 83/649 |
| 2003/0167893 | A1 * | 9/2003 | Morris et al. | 83/649 |
| 2003/0189125 | A1 * | 10/2003 | Trierenberg | 242/563 |
| 2005/0006520 | A1 * | 1/2005 | Gassner et al. | 242/555.3 |
| 2007/0102552 | A1 * | 5/2007 | Gambini | 242/160.1 |
| 2007/0114321 | A1 * | 5/2007 | Cattacin et al. | 242/596 |
| 2007/0228207 | A1 * | 10/2007 | Ikezawa | 242/556.1 |
| 2008/0087758 | A1 * | 4/2008 | Formon et al. | 242/563 |
| 2009/0177315 | A1 | 7/2009 | Goeking et al. | |
| 2011/0133010 | A1 * | 6/2011 | Pelland et al. | 242/160.4 |
| 2012/0109366 | A1 * | 5/2012 | Lowery et al. | 700/231 |

FOREIGN PATENT DOCUMENTS

| | | | |
|---|---|---|---|
| EP | 0 566 384 | 10/1993 | |
| JP | 1-150666 | 6/1989 | |
| NL | 2000717 C2 | 12/2008 | |
| WO | 2006/065515 | 6/2006 | |
| WO | WO 2009055473 A1 * | 4/2009 | A47K 10/36 |

* cited by examiner

SYSTEM FOR DISPENSING A STRIP OF ABSORBENT PRODUCT WOUND INTO A ROLL THAT COMPLIES THEREWITH

CROSS-REFERENCE TO PRIOR APPLICATIONS

This application is a §371 National Stage Application of PCT International Application No. PCT/FR2011/000412 filed Jul. 12, 2011, which claims priority to French Patent Application No. 10 56268 filed Jul. 29, 2010, both of which are incorporated herein in their entirety.

TECHNICAL FIELD OF THE INVENTION

The invention relates to a system for dispensing a web of absorbent product in the form of a roll.

The invention lies in the field of single-use rolls of paper used in particular by the general public or in away from home facilities and known under names such as toilet paper, wipe-all, kitchen rolls or paper towels.

GENERAL TECHNICAL BACKGROUND

For away-from-home use, the product is most often placed in a dispensing apparatus that protects the roll and dispenses the paper. Important functions of the dispenser that can be mentioned include the storage of the paper, hygiene, control of consumption, and of course the discharging of sheets.

Numerous examples of dispensing systems of this type are known.

In order to ensure the quality of the product dispensed, certain manufacturers have developed what are known as "captive" systems which are able to accommodate only one type of product or family of products determined in a given dispensing system.

Various systems exist to make the system "captive".

The prior art comprises in particular plastics end fittings or plugs which have a special form and are placed for example inside a core on which the product is wound and which engage with holders placed in the dispenser. Without these end fittings, the roll cannot be installed or cannot be used correctly.

The main drawback with this type of dispenser is of an economic nature: it is necessary to manufacture additional elements that are not of great benefit to the user of the system and which cannot be used once the roll is finished. These plastics components therefore represent an additional cost and cause additional waste once the roll is finished.

Also known are rolls having flanks provided with a groove that engages in each case with a special holder. In such a design, a roll without a groove cannot be held in the dispenser or else the door of the dispenser cannot be closed on account of the different space requirement of the grooveless roll compared with a compatible roll having a groove.

This type of system is effective but manufacturing these grooves requires complex roll conversion plants.

Also known, among automatic or semi-automatic, electric or electronic motorized dispensers, is the use of rolls having a central core which is provided with a marking such as a barcode, which can be read by a "reading device" or barcode reader which is arranged in the dispenser on a special holder. In particular two common means exist for reading barcodes. Most conventional is optical reading, which consists in passing a light beam over the barcode and then analysing the light reflected. The barcodes used can also be printed using a magnetisable ink, in which case reading will then be magnetic.

A "compatible" roll without a barcode is unable to start the motorized dispenser. As a result, paper cannot be unwound, or alternatively it cannot be unwound under normal operating conditions.

When the marking formed by the barcode is carried by the core, and most frequently by the concave internal surface of the core, this requires particular and complex implantation of the reader.

Document EP-B1-0 566 384 discloses a roll having a mark, or marking, which is able to be detected and identified and can be attached directly to the external surface, or front, of the wound web over the entire length of the roll.

Such a design can make it easier to arrange means for reading the marking.

However, such a solution can only be accepted with difficulty because it entails providing, on the visible external surface of all sheets, an unattractive motif, such as a barcode, and also requires means for marking the entire web before it is wound up to form a new roll.

Furthermore, the marking can affect the general properties of the product and thus affect all of a roll.

The object of the invention is to provide an economical system for making captive a dispenser for paper in the form of a roll, said dispenser being, for example, automatic or semi-automatic, electric or electronic, while using conventional means for converting the paper.

To this end, the invention provides a system for dispensing a web of absorbent product in the form of a roll, of the type comprising:

- a roll formed from a wound web of absorbent product, it being possible for said roll to be dispensed in successive sheets by progressive unwinding of the web in its longitudinal direction, the web having at least one characteristic mark of the roll;
- a dispenser for dispensing the absorbent product by rotation of the roll about an axis, of the type which has a fixed housing and means for holding and guiding the roll in rotation with respect to the housing, and of the type which has means for identifying said mark in order to determine whether a new roll installed in the dispenser is a compatible roll, characterized in that said mark is present on a free end section of the new roll, and in that this marked free end section is followed by at least one section that does not have a characteristic mark of the roll.

According to other features of the invention:

- in order to close the new roll, said free end section of the web is connected to an opposite portion of the wound web by connecting means forming at least one connecting region, and said mark is formed by at least one connecting region;
- said connecting means comprise a bonding fluid which is introduced between the back of said free end section and the front of the opposite portion of the wound web and a physical and/or chemical characteristic of which can be analysed by said identification means;
- said characteristic of the bonding fluid can be detected from outside the roll, through said free end section;
- said mark extends in a transverse direction with respect to the longitudinal direction of the web;
- said mark extends in the longitudinal direction of the web;

said characteristic mark of the roll is present on at least one other section of the roll which is located after said section that does not have a characteristic mark of the roll;

said mark is formed by a plurality of connecting regions;

said identification means comprise excitation means that emit incident radiation towards the surface of the web, means for receiving radiation reflected from the surface of the web and means for analysing the radiation reflected in order to determine the presence of a characteristic mark and to identify said mark in order to determine whether the new roll installed in the dispenser is a compatible roll.

BRIEF DESCRIPTION OF THE FIGURES

Further features and advantages of the invention will become apparent from reading the following detailed description, for the description of which reference is made to the appended drawings, in which.

DETAILED DESCRIPTION OF THE FIGURES

Figure 1:
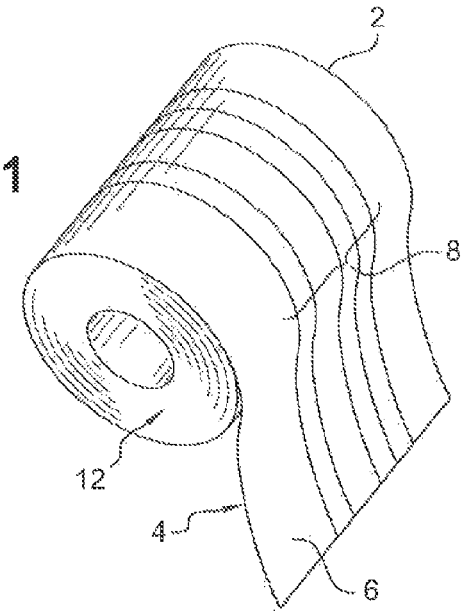
FIG. 1 is a schematic view of a marked roll according to the prior art.

In the following description, identical, analogous or similar components will be designated by the same reference numerals.

FIG. 1, according to the prior art, is a perspective view of a wound article 2, which is in the form of a wound web, in order to form a roll 12 having a general circular-cylindrical form, the external face 6, or front, of which has a printed barcode 8 made up of a number of parallel bars, which are spaced apart in the transverse direction, extending longitudinally along the entire length of the wound article 2, i.e. from the free end section 4, which in this case is partially unwound, as far as the internal free end (not visible), which is, for example, wound around a central core.

Such a product can, for example, be a roll 12 of a web 2 of absorbent paper product such as what is known as kitchen roll.

According to this prior art, if the product is discharged in successive sheets as it is used, manually or in a motorized dispenser, each sheet bears the printed barcode 8.

Figure 2:
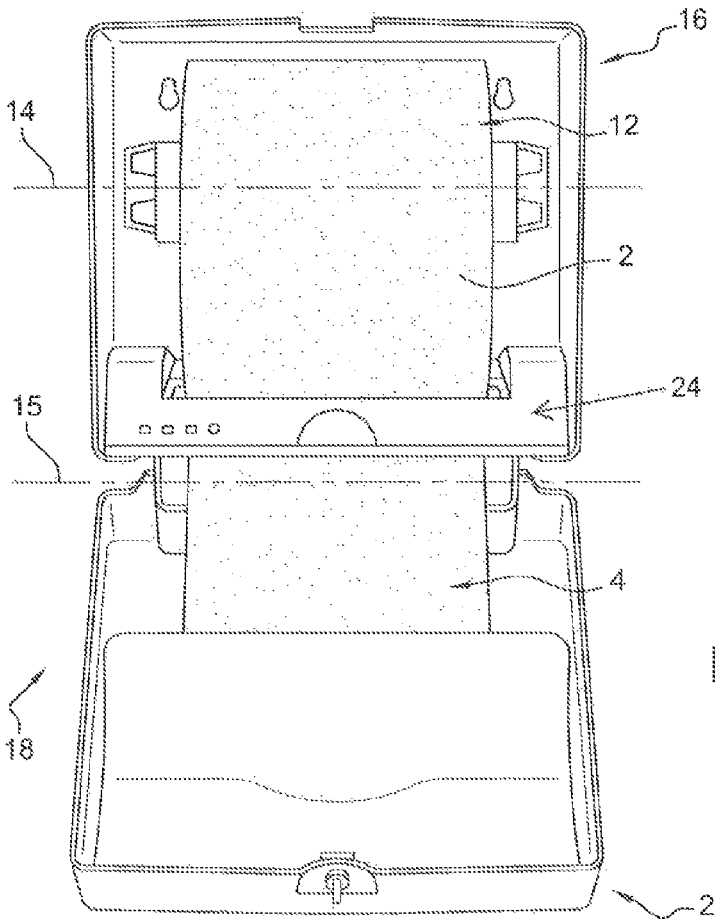
FIG. 2 is a view in the open position of a dispenser equipped with a roll.

FIG. 2 shows, schematically and in the open position, a dispenser 18 for dispensing a wound product 2 in the form of a roll 12, which is mounted able to rotate, in this case about a horizontal axis 14, in a fixed wall casing 16 forming a housing. The dispenser also has a pivoting cover 20 which is mounted able to rotate in the lower part about a horizontal axis and in this case is in the open lowered position.

The cover 20 has an outlet slot 22 through which the free end section 4 of the wound web 2 protrudes outwards from the casing in order to discharge and grip each cut sheet at the free end of the web of the roll when the dispenser 18 is in its normal use state with its cover 20 in the closed raised position.

The roll is, for example, rotated in this case, in particular in the unwinding direction of the web 2, by controlled motorized means (not shown in detail). The dispenser is thus known as an electric or electronic dispenser depending on the means used to trigger operation of the dispenser for unwinding a section corresponding to a sheet which can be severed automatically or manually by pulling on the discharged sheet protruding outwards from the casing 16.

Figure 3:
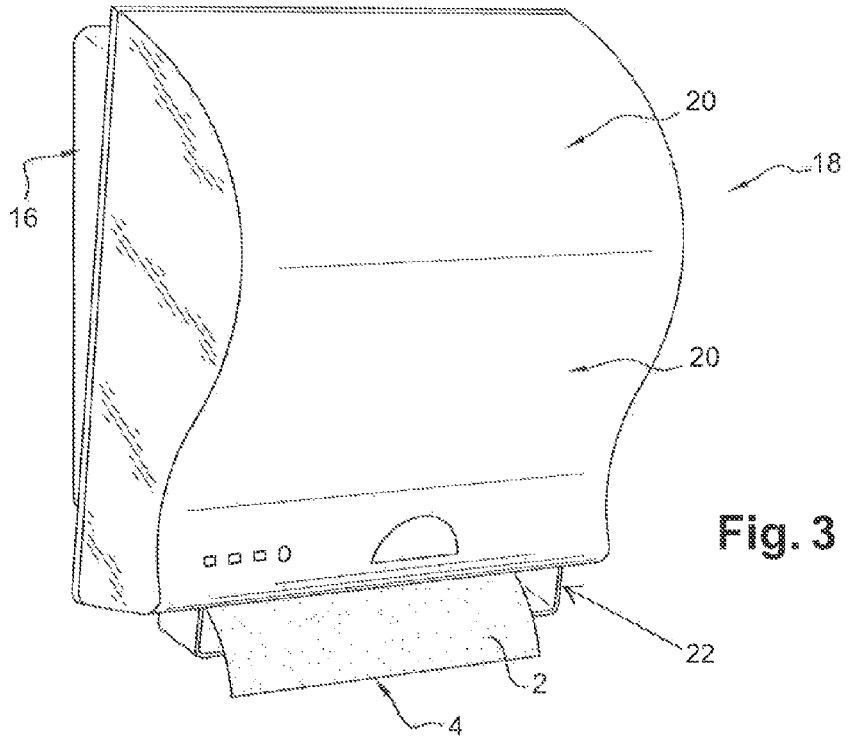
FIG. 3 is a view in the closed position of the dispenser in FIG. 2.

When a new roll 12 is installed in the dispenser 16, it is then held and guided in rotation in order to operate correctly and, as can be seen in FIG. 3, the free end of the next sheet to be discharged protrudes forwards and downwards in the lower part of the dispenser.

When a new roll 12 is installed, the person fitting this roll can, for example, cause the free end section 4 of the web 2 to start advancing in the unwinding direction by pressing an advancing button in what is known as a maintenance mode for feeding the "first sheet" into the dispenser.

In accordance with the invention, the roll 12 has a mark or marking 8 which is present only on a free end section of the roll 12.

Figure 4A:
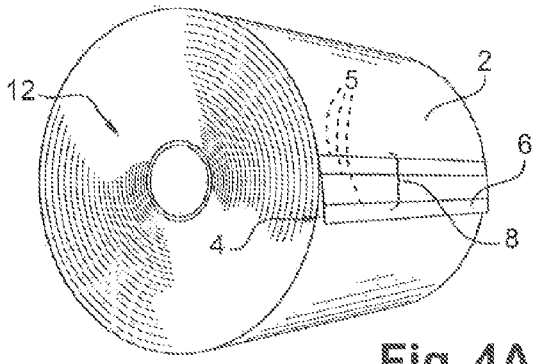
FIGS. 4A and 4B are views of two examples of a marked roll according to the invention.
Figure 4B:
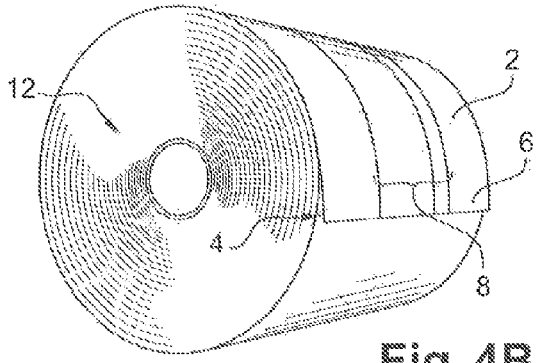

FIGS. 4A and 4B schematically show two examples of a such a mark 8, in this case in the form of a simplified barcode.

In FIG. 4B, the parallel lines of the barcode 8 are oriented in the longitudinal unwinding direction of the web 2, while in FIG. 4A, the parallel lines of the barcode 8 extend in the transverse direction, i.e. parallel to the axis of the roll 12.

As can be seen in FIGS. 4A and 4B, the mark or barcode 8 only extends over the free end section of the roll 12, i.e., after said roll 12 has been installed and its use has started, only the first sheet to be discharged, or a few of the first sheets discharged, will have the mark 8.

After this, the other sheets will no longer have the mark 8.

According to a first possibility, the mark 8, in this case in the form of a barcode, is printed on the free end section 4 of the web 2.

Such printing can be carried out by any means known in this field, for example by depositing or spraying a visible ink, by thermal marking, etc.

According to another possibility, and in accordance with another feature of the invention, the partial marking of the free end of the new roll is carried out in conjunction with the means for connecting the free end section 4 of the web 2 to the rest of the web forming the roll 12, in order to "close" the new roll.

Specifically, in a known manner, in order to close a new roll, i.e. in order that the web does not unwind accidentally during the various handling operations of the roll as it is manufactured, packaged and then unpacked with a view to using it, in particular in order to install it in a dispenser, it is known to "close the roll", i.e. to at least partially fix the free end section 4 of the web 2 (which will form the start of the roll when it is used) to the rest of the roll.

According to a first known technique, the means for connecting the free end section to the rest of the roll have one or more connecting regions which are produced by bonding, i.e. the bonding means comprise a bonding fluid 5.

In order for it to act in a bonding manner, the bonding fluid 5 is introduced between the back of the free end section 4 and the front of the opposite portion of the wound web 2 in the form of a roll 12.

In accordance with the invention, in order to form one or more connecting regions, the bonding fluid 5 used is of a kind that has a physical and/or chemical characteristic and can be analysed by identification means.

For example, the bonding fluid 5 may be coloured with an ink and the connecting regions may be produced in the form of bonding lines such that, following application of the bonding fluid 5 and closure of the roll, the coloured lines of bonding fluid 5 form the parallel lines of the barcode 8, said lines then being "visible" on the free end section 4 bonded in order to close the roll 12.

Depending on the conditions for producing the bond and on the fluid used, the coloured lines may be visible from the "outside" on the front 6 of the free end section 4 and/or from the "inside" on the back of the free end section 4.

If the coloured lines forming the barcode 8 can be detected from outside the roll "through" the sheet forming the end section, the identification means 24 are arranged opposite the external face of the roll.

Conversely, if the coloured lines can only be seen from the back of the sheet forming the free end section, the identification means 24 are arranged, in the dispenser, facing the back of the free end section 4 in such way that, when the latter is detached from the roll 12 during the installation of a new roll, the detection means are arranged facing the marked back.

According to another known technique for closing a roll, the free end section can be connected to the opposite portion of the wound web by "mechanical" means such as those illustrated, for example, in document U.S. Pat. No. 3,134,980.

When such a technique is used, the "mechanical" connecting regions also form "visible" regions likely to form identification marks for a compatible roll, it being possible for said marks then to be detected by associated detection means provided for this purpose.

Specifically, variations in the surface state and/or relief corresponding to these mechanical connecting regions make it possible to distinguish these connecting regions from the other parts of the web which do not have the mechanical connection.

The associated identification means 24 for detecting the mark on a compatible roll according to the invention can be produced by any known technique, in particular in order to detect a compatible roll.

The identification means 24 have excitation means which emit incident radiation towards the surface of the web (front and/or hack), said radiation being, for example, optical radiation; means for receiving the radiation reflected from the excited surface of the web; and means for analysing the reflected radiation in order to determine the presence of a characteristic mark and to identify said mark in order to determine, in a known manner, whether the new roll installed in the dispenser is a compatible roll.

The mark can be detected and identified for example as soon as a new roll is installed in the dispenser, for example by means of a manual advancing button which is provided for this purpose and is used to start feeding the web in the dispenser.

When the mark is identified and recognized as corresponding to a compatible roll, the dispenser can be put into the "conventional" operating mode with its cover closed.

If the mark is not detected, or if the mark detected is not identified as corresponding to a compatible roll, the dispenser 18 puts itself into a "degraded" state in which it can be stopped or in which, for example, the length of the discharged sheet is reduced or increased compared with a "normal" sheet length.

Of course, the invention is not limited to marking of the barcode type, the forms and orientations of the marks can vary.

Similarly, the physico-chemical nature of the marks is not limited to visible marks or marks which can be detected and identified in the visible range.

In the examples which have just been described, the characteristic mark of the roll is present only on a free end section of the new roll.

According to a variant which is not shown, and without departing from the scope of the invention, the characteristic mark of the roll is present on at least one other section of the roll, said section being located after a section which does not have a characteristic mark of the roll and is interposed longitudinally between the marked free end section and this other marked section.

The distance between these two marked sections may be several meters.

The presence of such a second marked section, while avoiding the drawbacks which are inherent to a continuous marking over the entire length of the web forming the roll, makes it possible to carry out, if necessary, another check of the compatibility of the roll.

The invention claimed is:

1. A system for dispensing a web of absorbent product in the form of a roll, the system comprising:

a roll formed from a wound web of absorbent product, the roll extending in a longitudinal direction of the web from an internal free end provided on an inner surface of the roll to a free end section provided on an outer surface of the roll, said roll being dispensed in successive sheets by progressive unwinding in the longitudinal direction of the web, the web having at least one characteristic mark of the roll; and a dispenser for dispensing the absorbent product by rotation of the roll about an axis, the dispenser having a fixed housing, the dispenser having a controlled motorized device for discharging a predetermined amount of the roll corresponding to a sheet which is severed automatically or manually by pulling on the discharged sheet protruding outwards from the housing, and a reading device that reads and recognizes the characteristic mark to determine whether the roll installed in the dispenser is compatible with the dispenser, wherein said mark is present only on the free end section of the roll corresponding to one or more of the first few sheets of the roll to be discharged, and wherein in order to close the roll, said free end section of the web is connected to a radially adjacent portion of the wound web by connecting means, said mark being at least partly formed by the connecting means.

2. The system according to claim 1, wherein said connecting means comprise a bonding fluid:

which is introduced between a back of said free end section and a front of the radially adjacent portion of the wound web;

and a physical and/or chemical characteristic of which can be analyzed by said reading device.

3. The system according to claim 2, wherein said characteristic of the bonding fluid can be detected from outside the roll, through said free end section.

4. The system according to claim 1, wherein said mark extends in a transverse direction with respect to the longitudinal direction of the web.

5. The system according to claim 1, wherein said mark extends in the longitudinal direction of the web.

6. The system according to claim 1, wherein said connecting means forms a plurality of connecting regions, said mark being formed by the plurality of connecting regions.

7. The system according to claim 1, wherein said reading device comprises:

excitation means that emit incident radiation towards the surface of the web;

means for receiving radiation reflected from the surface of the web; and means for analyzing the radiation reflected in order to determine the presence of the characteristic mark and to identify said mark in order to determine whether the roll installed in the dispenser is compatible with the dispenser.

8. The system according to claim 1, wherein said reading device is an optical or magnetic barcode reader.

9. The system according to claim 1, wherein the mark is present only on the first sheet of the roll to be discharged.

* * * * *